US006875048B2

(12) United States Patent
Lee

(10) Patent No.: US 6,875,048 B2
(45) Date of Patent: Apr. 5, 2005

(54) CABLE END CONNECOTR ASSEMBLY WITH IMPROVED CONTACT

(75) Inventor: George Lee, Irvine, CA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 81 days.

(21) Appl. No.: 10/607,425

(22) Filed: Jun. 25, 2003

(65) Prior Publication Data

US 2004/0266255 A1 Dec. 30, 2004

(51) Int. Cl.[7] ..... H01R 12/24
(52) U.S. Cl. ..... 439/497
(58) Field of Search ..... 439/606, 449, 439/499, 497, 492, 83, 101, 108, 874, 597

(56) References Cited

U.S. PATENT DOCUMENTS 4,367,004 A * 1/1983 Fujiura et al. ..... 439/396
6,585,537 B1 * 7/2003 Lee ..... 439/606
6,616,477 B1 * 9/2003 Chang ..... 439/465
6,648,676 B1 * 11/2003 Lee ..... 439/499
6,653,569 B1 * 11/2003 Sung ..... 439/567

* cited by examiner

*Primary Examiner*—Renee Luebke
*Assistant Examiner*—Felix O. Figueroa
(74) *Attorney, Agent, or Firm*—Wei Te Chung

(57) ABSTRACT

A cable end connector assembly including an insulative housing (10), a plurality of signal and grounding contacts (21), (22), a spacer device (30), a cable (40), and an over-molding cover (50). The insulative housing has a base, the base having a mating section defining a receiving space therein adapted for receiving a mating portion of the complementary connector. The signal and grounding contacts are mounted in the housing, each contact has an engaging portion, a rear connecting portion, and a tail portion extends rearwardly from the connecting portion, at least one tail portion of the grounding contact has a fork-shape. The cable has a number of conductors each electrically connecting a corresponding contact. The cover is over-molded with and encloses a rear end of the housing and the front end of the cable.

4 Claims, 3 Drawing Sheets

CABLE END CONNECOTR ASSEMBLY WITH IMPROVED CONTACT

BACKGROUND OF THE INVENTION

1. Field of the Invention

The present invention relates to an electrical connector assembly, particularity to a cable end connector including improved contact members for transmitting signal and grounding contacts, whereby the connector can achieve a good electrical connection with a complementary connector.

2. Description of Related Art

Serial Advanced Technology Attachment (SATA) is a high speed interface between storage devices (such as hard disks, CD-ROMs, and DVDs) and a mother board. Because of the numerous advantages of Serial ATA, it is developed as a replacement for Parallel ATA and Ultra ATA.

Generally, for a conventional electrical cable end according to the SATA, in assembly process, in order to have good quality of soldering, alignment between conductors and contacts is very time consuming which leads to a high manufacturing cost, and the cable alignment process needs long time for aligning the conductors of the cable connecting the signal and grounding contacts respectively. Such a connecting operation is expensive and inconvenient. It is desired to provide a new structure of grounding contact to connect the conductor so that manufacturing and assembling process can be simplified and cost can be reduced.

SUMMARY OF THE INVENTION

An object, therefore, of the present invention is to provide a cable end connector assembly having improved contacts for directly connecting conductors of a cable without requiring alignment process.

In order to achieve the objects set forth, a cable end connector assembly comprises an insulative housing, a plurality of signal and grounding contacts, a spacer device, a cable, and an over-molding cover.

The insulative housing has a mating section defining a receiving space therein adapted for receiving a mating portion of a complementary connector. The signal and grounding contacts are mounted in the housing. Each contact has an engaging portion, a connecting portion, and a tail portion extending rearwardly from the connecting portion, at least one tail portion of the grounding contact has a fork-shape. A cable has a plurality of conductors each electrically connecting a corresponding contact. A cover is over-molded with and encloses a rear end of the housing and the front end of the cable.

Other objects, advantages and novel features of the invention will become more apparent from the following detailed description when taken in conjunction with the accompanying drawings.

DETAILED DESCRIPTION OF THE INVENTION

Figure 1:
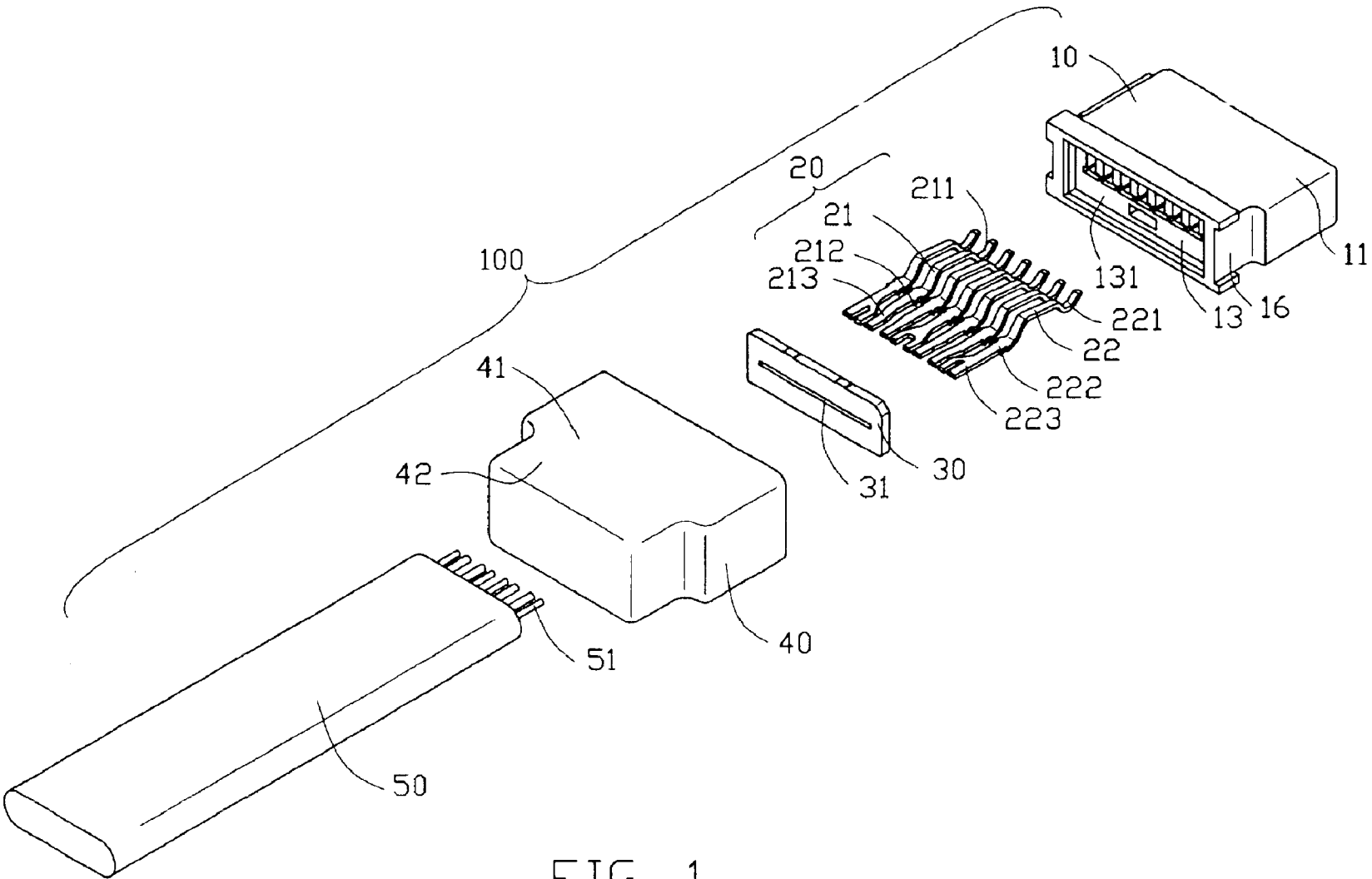
FIG. 1 is an exploded, perspective view of a cable end connector assembly in accordance with the present invention.
Figure 2:
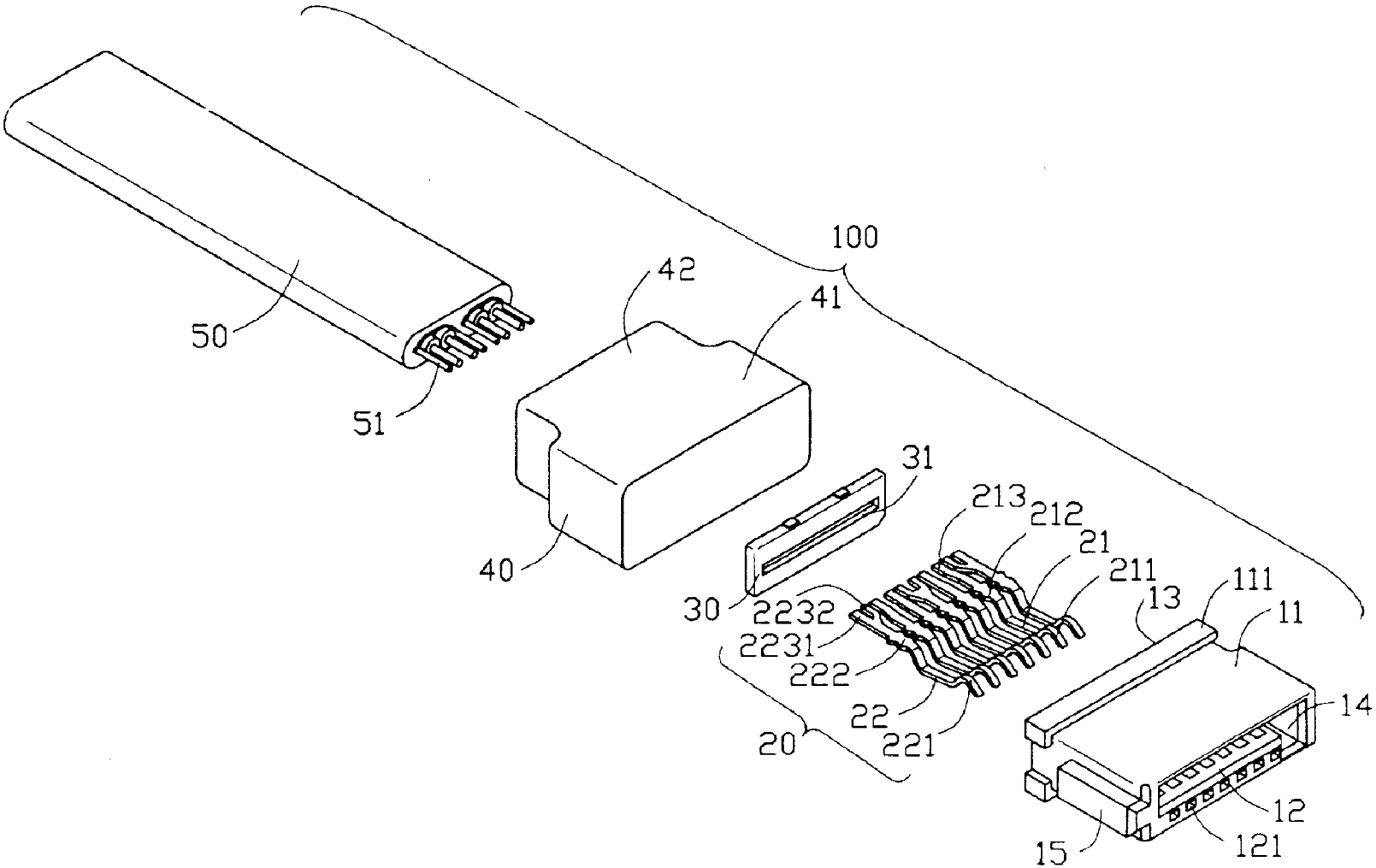
FIG. 2 is a view similar to FIG. 1, but taken from a different aspect.
Figure 3:
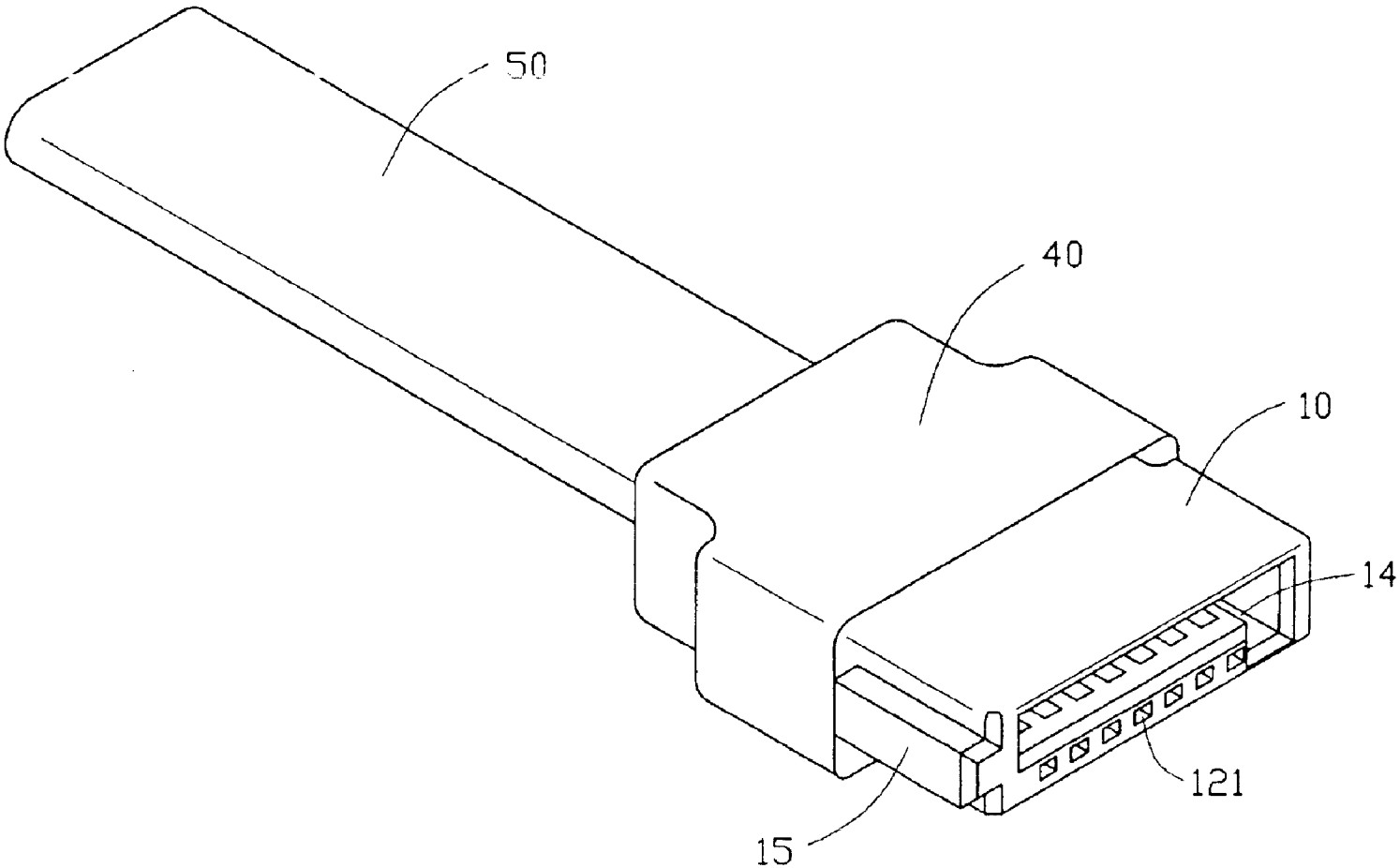
FIG. 3 is a fully assembled view of the cable end connector assembly.

Referring to FIGS. 1–3, a cable end connector assembly 100 comprises an insulative housing 10, a contact insert 20, a spacer device 30, a cable 40, and an over-molding cover 50 separately drawn for ease of illustration and description.

Referring to FIGS. 1–2, the insulative housing 10 comprises a rectangular base 11. The base 11 has a mating section 12 and a rear portion 13. The base 11 defines a receiving space 14 for receiving the mating portion of a complementary connector (not shown). The mating section 12 defines a plurality of passageways 121 extending rearwardly through the base 11. The rear portion 13 defines a rectangular depression 131. A pair of flanges 111 are formed on an upper and a lower surfaces of the base 11. The base 11 defines a recess 16 on a lateral side thereof. The base 11 further forms a projection 15 at another lateral sides thereof for guiding the cable end connector 100 to mate with the complementary connector.

The contact insert 20 comprises a plurality of signal contacts 21 and grounding contacts 22 for transmitting signals and grounding, respectively. The contact set 20 has seven contacts, the first, fourth, and seventh contacts (not labeled) are grounding contacts 22, and all of others are signal contacts 21. Each contact 21, 22 comprises an engaging portion 211, 221 received into a corresponding passageway 121, a connecting portion 212, 222 connecting the engaging portion 211, and a tail portion 213, 223. The tail portion 213, 223 of the signal contact 21 and grounding contact 22 extend rearwardly from the connecting portion 212 223. The tail portions 223 of the first and seventh grounding contacts 22 each has a bent portion 2231 and a fork-shaped portion 2232, and the tail portion of the fourth grounding contact 223 is fork-shaped.

The spacer device 30 defines a slender passageway 31. The spacer 30 is inserted into the depression 131 of the insulative housing 10 for preventing the molten PVC from flowing to the mating section 12 of the insulative housing 10. The tail portions 213, 223 of the contact insert 20 extend through the slender passageways 31 of the spacer 30. The tail portions 213, 223 of the signal contacts 21 and the grounding contacts 22 connect to the cable 50.

The cable 50 comprises a plurality of conductors 51 extending forwardly beyond a front end thereof and connecting the tail portions 213, 223 of the signal and grounding contacts 21, 22, respectively. The fork-shaped tail portion 223 is directly connected to the conductor 51 without needing re-alignment process.

The cover 40 is over-molded to the housing 10 and the cable 50. The cover 40 is made of PVC and comprises a rectangular body 41, and a rear portion 42 extending rearwardly from the body 41.

Referring to FIGS. 1 and 2, in assembly, the contact insert 20 is first assembled into the housing 10 along a rear-to-front direction. The engaging portions 211 of contacts are received into the passageways 121, respectively. The tail portions 213 223 of signal and grounding contacts are exposed outside the housing 2. The spacer 30 is inserted into the depression 131. The tail portions 213, 223 of signal and grounding contacts 21 are fitted through the slender passageway 31 of the spacer 30. The spacer 30 prevents molten PVC from flowing into the mating portion 22 via the passageways 121 when the cover 40 is over-molded to the housing 10 and the cable 50.

The conductors 51 of the cable 50 are soldered to the corresponding tail portions 213, 223 of the signal and grounding contacts 21, 22, respectively. The conductors 51 connect to the fork-shaped tail portions 2232 of the grounding contacts 22 and the tail portions 213 of the signal contacts 21 directly without needing re-alignment process.

The cover 40 is then over-mold to the rear portion 23 of the housing 10 and the front end of the cable 50. The insulative housing 10 engages with the over-molding cover 40 securely by the flanges 111.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

an insulative housing defining a mating port;

a plurality of signal and grounding contacts disposed in the housing in a mixed-up manner along a lateral direction of the housing, the contacts including engaging portions equidistantly arranged with one another along said lateral direction, each of said contacts essentially defining a central axis, along a longitudinal direction perpendicular to said lateral direction, relative to which the corresponding engaging portion is symmetric; and a cable located on a rear portion of the housing and including plural pairs of wires each defining a signal conductor and a grounding conductor extending in said longitudinal direction, the signal conductor and the grounding conductor of each of said pair spaced, along said lateral direction, from each other with a distance which is smaller than that between either of said signal conductor and said grounding conductor and another neighboring conductor of the adjacent pair along said lateral direction; wherein the contacts further includes respectively a plurality of tail soldering portions corresponding to said signal conductors and said grounding conductors in a one-to-one manner, and some of said tail soldering portions are intentionally offset, along said lateral direction, from the corresponding central axis so as to actively align, along the longitudinal direction, with the corresponding one of said signal conductors and said grounding conductors without requirement of adjustment of the corresponding conductors along said lateral direction.

2. The assembly as claimed in claim 1, wherein the offset tail soldering portions are soldered with the grounding conductors.

3. A cable end connector assembly comprising:

an insulative housing defining a mating port;

a plurality of signal and grounding contacts disposed in the housing in a mixed-up manner along a lateral direction of the housing, the contacts including engaging portions equidistantly arranged with one another along said lateral direction, each of said contacts essentially defining a central axis, along a longitudinal direction perpendicular to said lateral direction, relative to which the corresponding engaging portion is symmetric;

a cable located on a rear portion of the housing and including plural pairs of wires each defining a signal conductor and a grounding conductor extending along said longitudinal direction, the signal conductor and the grounding conductor of each of said pair spaced, along said lateral direction, with a first distance which is smaller than that between either of said signal conductor and said grounding conductor and another neighboring conductor of the adjacent pair;

the signal and grounding contacts further including a plurality of tail portions corresponding to said signal conductors and said grounding conductors, respectively, and the tail portions of the signal contacts and those of the grounding contacts being configured different from each other, wherein the tail portion of at least one of said grounding contacts is wider than the tail portion of the signal contact in said lateral direction so as to allow the corresponding grounding conductor to be soldered thereon without adjustment along said lateral direction.

4. The assembly as claimed in claim 3, wherein said tail portion of the at least one of said grounding contacts is of a fork type while the tail portion of the signal is of a straight type.

* * * * *